US005141432A

United States Patent [19]

Bell et al.

[11] Patent Number: 5,141,432

[45] Date of Patent: Aug. 25, 1992

[54] APPARATUS AND METHOD FOR COMBUSTION WITHIN POROUS MATRIX ELEMENTS

[75] Inventors: Ronald D. Bell; William C. Gardiner; John R. Howell; Mark M. Koeroghlian; Ronald D. Matthews; Steven P. Nichols, all of Austin, Tex.

[73] Assignees: Radian Corporation; The Board of Regents, The University of Texas System, both of Austin, Tex.

[21] Appl. No.: 670,286

[22] Filed: Mar. 15, 1991

Related U.S. Application Data

[63] Continuation-in-part of Ser. No. 554,748, Jul. 18, 1990, abandoned.

[51] Int. Cl.[5] ..... F23D 3/40

[52] U.S. Cl. ..... 431/7; 431/10; 431/328; 431/346

[58] Field of Search ..... 431/7, 10, 160, 170, 431/328, 326, 346

[56] References Cited

U.S. PATENT DOCUMENTS

| | | | |
|---|---|---|---|
| 1,225,381 | 5/1917 | Wedge | 431/328 |
| 3,846,979 | 11/1974 | Pfefferle . | |
| 4,087,962 | 5/1978 | Beremand et al. . | |
| 4,112,676 | 9/1978 | DeCorso . | |
| 4,270,896 | 6/1981 | Polinski et al. | 431/328 |
| 4,285,193 | 8/1981 | Shaw et al. . | |
| 4.405,587 | 9/1983 | McGill et al. . | |
| 4,459,126 | 7/1984 | Krill | 431/7 |
| 4,534,165 | 8/1985 | Davis, Jr. et al. . | |
| 4,643,667 | 2/1987 | Fleming . | |
| 4,726,181 | 2/1988 | Pillsbury . | |
| 4,730,599 | 3/1988 | Kendall et al. . | |
| 4,731,989 | 3/1988 | Furuya et al. . | |
| 4,787,208 | 11/1988 | DeCorso . | |
| 4,811,555 | 3/1989 | Bell . | |

OTHER PUBLICATIONS

"Premixed Combustion in Porous Inert Media." Y-K Chen et al. Proceedings of the Joint Meeting of the Japanese and Western States Sections of the Combustion Institute, pp. 266-268, 1987.

"Experimental and Theoretical Investigation of Combustion in Porous Inert Media," Y-K Chen et al., Paper PS-201. Twenty-Second Symposium (International) on Combustion, 1988.

"The Effect of Radiation on the Structure of Premixed Flames Within A Highly Porous Inert Medium." Y-K Chen et al., Radiation, Phase Change, Heat Transfer, and Thermal Systems, ed. by Y. Jaluria, et al., ASME Publication HTD, vol. 81, 1987.

*Primary Examiner*—James C. Yeung

*Attorney, Agent, or Firm*—Klauber & Jackson

[57] ABSTRACT

Burner apparatus for use in controlled low $NO_x$ combustion. Mixing and flow-directing means receive and mix fuel and air provided thereto and form a flow of the resulting combustible mixture. A combustion zone defined by a porous high temperature-resistant matrix includes an input end for receiving the combustible flow. Cooling means are mounted in proximity to the input end of the combustion zone, for maintaining the temperature of the flowing combustible mixture proximate the input end below ignition temperature, thereby limiting the flame produced by combustion in the porous matrix to the downstream side of the cooling means. The method for controlled low $NO_x$ combustion is also disclosed and claimed.

13 Claims, 2 Drawing Sheets

APPARATUS AND METHOD FOR COMBUSTION WITHIN POROUS MATRIX ELEMENTS

RELATED APPLICATION

This application is a continuation-in-part of copending application Ser. No. 554,748, filed Jul. 18, 1990, abandoned.

1. Field of the Invention

This invention relates generally to combustion apparatus and methodology, and more specifically relates to an improved combustion apparatus and method which provides increased flame control and stability, and which is especially effective in the reduction of $NO_x$ emissions.

2. Background of the Invention

Environmental pollution caused by combustion-generated $NO_x$ emissions, is a matter of great concern to the public, and as well to industrial fuel users. Beginning in the 1960's, governmental agencies, indeed prompted by public concern with increasing levels of smog and air pollutants, imposed $NO_x$ reduction requirements upon existing power plants in major metropolitan areas. Industry, accepting the challenge, has already developed a large variety of technologies to meet the new needs. Modifying the combustion process has become the most widely used technology for reducing combustion generated $NO_x$. In addition, a number of flue gas treatment technologies have been developed and are emerging as the primary method of control for certain applications, but have seen limited use where natural gas is the fuel of choice.

Oxides of nitrogen ($NO_x$) are formed in combustion processes as a result of thermal fixation of nitrogen in the combustion air ("thermal $NO_x$"), by the conversion of chemically bound nitrogen in the fuel, or through "prompt-$NO_x$" formation. In addition to generating "thermal $NO_x$", i.e., by high temperature combination of free nitrogen and oxygen, where the fuels employed by such users (e.g. coal gas) contain substantial quantities of chemically bound nitrogen, certain combustion conditions will favor the formation of undesirable NO-type compounds from the fuel-bound nitrogen. "Prompt $NO_x$" refers to oxides of nitrogen that are formed early in the flame and do not result wholly from the Zeldovich mechanism. Prompt-$NO_x$ formation is caused by 1) interaction between certain hydrocarbon components and nitrogen components and/or, 2) an overabundance of oxygen atoms that leads to early $NO_x$ formation. For natural gas firing, virtually all of the $NO_x$ emissions result from thermal fixation, which is commonly referred to as "thermal $NO_x$", or from prompt $NO_x$. The formation rate is strongly temperature dependent and generally occurs at temperatures in excess of 1800° K. (2800° F.) and generally is more favored in the presence of excess oxygen. At these temperatures, the usually stable nitrogen molecule dissociates to form nitrogen atoms which then react with oxygen atoms and hydroxyl radicals to form, primarily, NO.

In general, $NO_x$ formation can be retarded by reducing the concentrations of nitrogen and oxygen atoms at the peak combustion temperature or by reducing the peak combustion temperature and residence time in the combustion zone. This can be accomplished by using combustion modification techniques such as changing the operating conditions, modifying the burner design, or modifying the combustion system.

Of the combustion modifications noted above, burner design modification is most widely used. Low $NO_x$ burners are generally of the diffusion burning type, designed to reduce flame turbulence, delay the mixing of fuel and air, and establish fuel-rich zones where combustion is initiated. Manufacturers have claimed 40 to 50 percent nominal reductions, but significant differences in the predicted $NO_x$ emissions and those actually achieved have been noted. The underlying cause for these discrepancies is due to the complexity in trying to control the simultaneous heat and mass transfer phenomena along with the reaction kinetics for diffusion burning. In addition, it is extremely difficult to obtain representative samples from the flame envelope of this type of burner, which when analyzed, can provide the necessary data to improve predictive models.

Illustrative of the foregoing and related techniques for $NO_x$ reduction, are the disclosures of the following U.S. Pat Nos.:

DeCorso, U.S. Pat. No. 4,787,208 discloses a low-$NO_x$ combustor which is provided with a rich, primary burn zone and a lean secondary burn zone. $NO_x$ formation is inhibited in the rich burn zone by an oxygen deficiency, and in the lean burn zone by a low combustion reaction temperature. Ceramic cylinders are used at certain parts of the combustion chambers.

Furuya et al, U.S. Pat. No. 4,731,989 describes a combustion method for reducing $NO_x$ emissions, wherein catalytic combustion is followed by non-catalytic thermal combustion.

Davis, Jr. et al. U.S. Pat. No. 4,534,165 seeks to minimize $NO_x$ emissions by providing operation with a plurality of catalytic combustion zones and a downstream single "pilot" zone to which fuel is fed, and controlling the flow of fuel so as to stage the fuel supply.

DeCorso, U.S. Pat. No. 4,112,676 shows a combustor generally of the diffusion burning type for a gas turbine engine.

Pillsbury, U.S. Pat. No. 4,726,181 provides combustion in two catalytic stages in an effort to reduce $NO_x$ levels.

Kendall et al, U.S. Pat. No. 4,730,599 discloses a gas-fire radiant tube heating system which employs heterogeneous catalytic combustion and claims low-$NO_x$ catalytic combustion.

Shaw et al, U.S. Pat. No. 4,285,193 describes a gas turbine combustor which seeks to minimize $NO_x$ formation by use of multiple catalysts in series or by use of a combination of non-catalytic and catalytic combustion.

Pfefferle, U.S. Pat. No. 3,846,979 describes low $NO_x$ emissions in a two-stage combustion process wherein combustion takes place above 3300° F., the effluent is quenched, and the effluent is subjected to catalytic oxidation.

Beremand et al, U.S. Pat. No. 4,087,962, discloses a combustor which utilizes a non-adiabatic flame to provide a low emission combustion for gas turbines. The fuel-air mixture is directed through a porous wall, the other side of which serves as a combustion surface. A radiant heat sink is disposed adjacent to the second surface of the burner so as to remove radiant energy produced by the combustion of the fuel-air mixture, and thereby enable operation below the adiabatic temperature. The inventors state that the combustor operates near the stoichiometric mixture ratio, but at a temperature low enough to avoid excessive $NO_x$ emissions. In one embodiment the radiant heat sink comprises a further porous plate.

In U.S. Pat. No. 4,811,555, of which Ronald D. Bell, one of the applicants of the present application, is patentee, there is described a cogeneration system in which $NO_x$ is controlled by the treatment of the turbine exhaust by a combination of combustion in a reducing atmosphere and catalytic oxidation.

In McGill et al, U.S. Pat. No. 4,405,587, for which Ronald D. Bell is a co-patentee, the $NO_x$ content of a waste stream is controlled by treating it and subjecting it to high-temperature combustion in combined reducing and oxidation zones.

Recent work by several of the present co-inventors and others, has resulted in a combustion device which utilizes a highly porous inert media matrix to provide for containment of the combustion reaction within the porous matrix—which may comprise fibers, beads, or other material which has a high porosity and a high melting temperature. Preferably, a ceramic foam is used. This ceramic, sponge-like material has a porosity (typically about 90%) which provides a flow path for the combustible mixture. The energy release by the gas phase reactions raises the temperature of the gases flowing through the porous matrix in the postflame zone. In turn, this convectively heats the porous matrix in the postflame zone. Because of the high emissivity of the solid in comparison to a gas, radiation from the high temperature postflame zone serves to heat the preflame zone of the porous material which, in turn, convectively heats the incoming reactants. This heat feedback mechanism results in several interesting characteristics relative to a free-burning flame. These include higher burning rates, higher volumetric energy release rates, and increased flame stability resulting in extension of both the lean and rich flammability limits. In addition to the ability to achieve very high radiant output from a very compact combustor, flame temperature increases are negligible. This is an important consideration with respect to $NO_x$ control purposes.

A one-dimensional mathematical model was constructed that included both radiation and accurate multi-step chemical kinetics. This model was used to predict the flame structure and burning velocity of a premixed flame within an inert, highly porous medium. The various predictions of this model have been discussed by Chen et al. See "The Effect of Radiation on the Structure of Premixed Flames Within a Highly Porous Inert Medium", Y-K Chen, R. D. Matthews, and J. R. Howell, *Radiation, Phase Change, Heat Transfer, and Thermal Systems,* ed. by Y. Jaluria, V. P. Carey, W. A. Fiveland, and W. Yuen (eds.), ASME Publication HTD-Vol. 81, 1987. "Premixed Combustion in Porous Inert Media"; Y-K Chen, R. D. Matthews, J. R. Howell, Z-H Lu, and P. L. Varghese, *Proceedings of the Joint Meeting of the Japanese and Western States Sections of the Combustion Institute,* pp. 266–268, 1987; and "Experimental and Theoretical Investigation of Combustion in Porous Inert Media", Y-K Chen, R. D. Matthews, I-G Lim, Z. Lu, J. R. Howell, and S. P. Nichols, Paper PS-201, *Twenty-Second Symposium (International) on Combustion,* 1988. These papers demonstrate that a porous matrix (PM) combustor can provide a number of advantages over diffusion burners. However, these papers are focused on the development of this new concept, but are not concerned with the problem of $NO_x$ emissions, much less with the effective reduction of same.

The latter issue is, however, addressed in our parent Ser. No. 554,748 application in which low $NO_x$ combustion is effected by a method wherein a fuel, e.g., natural gas, and a source of oxygen, e.g., air, are mixed and the mixture is combusted in at least two successive combustion zones filled with a porous matrix, the void spaces of which provide sites at which substantially all of the said combustion occurs; viz. a first zone wherein the mixture is fuel-rich, and a second zone wherein the mixture is fuel-lean. Preferably, the method utilizes an additional combustion zone which precedes or is upstream of the first zone and is filled with a said porous matrix, wherein the mixture is fuel-lean.

A serious problem that has been experienced with PM burners arises from flame flashback from the postflame to preflame zones. The latter may include ceramic foam and/or flow mixing and distributing means such as ceramic honeycomb, glass beads or other media, or simply media void mixing space. Flashback of the flame from the postflame zone where combustion is desired, aside from creating potential or actual danger, by definition is uncontrolled burning—which is precisely the condition sought to be avoided in order to preclude or limit $NO_x$ formation. It might be thought that by providing a sufficient rate of fuel/air flow through the PM combustion zone, the problem could be eliminated, i.e. by using a flow rate exceeding the possible rate of back propagation of the flame. It develops, however, that in the real system present in the PM burner, the porous media, as for example where same is in the general shape of a solid cylinder, acts with respect to the normally axial flow of the fuel-air mixture through such cylinder, to cause an uneven rate of flow across a plane transverse to the cylinder. Specifically, there will tend to be flow stagnation at the peripheral walls of the cylinder, as opposed to the generally maximum flow rate occurring at the axis. Accordingly, merely increasing the rate of flow of the fuel-air mixture is not generally sufficient to assure the absence of undesired flame flashback to the preflame zone.

The problem presented by the foregoing is recognized in Fleming, U.S. Pat. No. 4,643,667. In this, Fleming discloses a noncatalytic porous phase combustor comprising a porous plate having at least two discrete and contiguous layers, a first preheat layer comprising a material having a low inherent thermal conductivity, and a second combustion layer comprising a material having a high inherent thermal conductivity and also providing a radiating surface. The presence of the low conductivity material tends to limit the heating in that initial zone, thereby discouraging flashback. The construction recommended by Fleming is, however, a very complex and difficult one to achieve. Furthermore, the presence of the contiguous low conductivity material, while affording advantages as aforementioned, also introduces a pressure drop into the flow, with no commensurate benefits.

In accordance with the foregoing, it may be regarded as an object of the present invention to provide apparatus and method improvements applicable to porous media burners, which reduce or preclude flame flashback from the combustion zone, thereby providing highly improved control and stability in the flame, in turn enabling better control of $NO_x$ generation.

It is a further object of the invention, to provide apparatus and methods as aforementioned, which are applicable to both single and multiple stage porous media burners.

SUMMARY OF THE INVENTION

Now in accordance with the present invention, burner apparatus based upon use of porous inert media are provided, which by virtue of the highly controlled and stabilized flame conditions achieved therein, are particularly well adapted for use in controlled low $NO_x$ combustion. In the apparatus of the invention, mixing and flow directing means are provided for receiving and mixing a fuel, e.g. natural gas, and a source of oxygen, e.g. air, and forming a flow of the combustible mixture. The combustible mixture is flowed downstream to a combustion zone defined by a porous high temperature-resistant matrix, the void spaces of which provide sites at which substantially all of the combustion occurs, which zone includes an input end for receiving the combustible flow from the mixing and flow directing means. Cooling means are mounted in proximity to the input end of the combustion zone for maintaining the temperature of the combustible mixture at the input end below ignition temperature, to thereby limit the flame produced by combustion in the porous matrix to the downstream or postflame side of the cooling means. The cooling means typically comprises a generally toroidal metal body which is provided with one or more internal cooling channels. This body surrounds, and is in thermal contact with the input end of the combustion zone. Means are provided for circulating a coolant through the body, which coolant can typically be water but may be other liquid media or a gas, including air. The cooling body is so mounted as to be nonintrusive with respect to the porous matrix in the combustion zone, so as to introduce no impedance to the flowing fuel and oxygen source mixture.

The invention is applicable to a single stage porous matrix burner, as well as to the multiple stage devices which are disclosed in our parent application Ser. No. 554,748. In any of these instances, the cooling means is positioned as to be at the input end (i.e. in advance) of the first (or single) stage whereat combustion is to be effected. The cooling stage in each instance acts to produce a sharp discontinuity in temperature so that even where the flow stagnation effect aforementioned (which tends to occur at the periphery of the porous matrices) is present, there is substantially no danger of flashback from the flame of combustion which exists in the postflame PM zone(s). By eliminating the flashback potential, it is found that extremely stable, well-formed flames result, which in turn provide the highly controlled combustion conditions which are one of the objectives sought after in porous media burners, for the special objective of reducing generation of $NO_x$.

In accordance with the method of the invention, a combustion process is thus provided enabling controlled low $NO_x$ combustion. Fuel and an oxygen source such as air are mixed and formed into a combustible flow stream. The flow stream is passed to an input end of a combustion zone defined by a porous high temperature-resistant matrix. The mixture is combusted at the matrix, the void spaces of which provide sites at which substantially all of the said combustion occurs, and the combustion products are flowed from an output end of the matrix. The input end of the combustion zone is cooled, to maintain the temperature of the combustible mixture at the said input end below ignition temperature, thereby limiting the flame produced by combustion in the porous matrix to the downstream side of the cooling means.

The present invention can effectively be used in the method and apparatus of our Ser. No. 554,748 application, abandoned. As taught therein, low $NO_x$ combustion is effected by a method wherein a fuel, e.g., natural gas, and a source of oxygen, e.g., air, are mixed and the mixture is combusted in at least two successive zones, each filled with a porous high temperature resistant matrix the void spaces of which provide sites at which substantially all of the process combustion occurs; viz., a fuel-rich zone wherein combustion of the mixture occurs under fuel-rich conditions, and a lean burn zone which is downstream of the fuel-rich zone, and which receives the combustion products from the fuel-rich zone together with additional air to complete the oxidation. Preferably, the method utilizes an additional lean burn combustion zone filled with the porous matrix, which zone precedes, i.e. is upstream of the fuel-rich zone. Thus when there are two zones or stages, a fuel-rich mixture is burned in the first stage, and a lean mixture is burned in the second stage. When there are three successive zones (or stages), a lean mixture is burned in the first stage, a rich mixture is burned in the second stage, and the mixture in the third stage is a lean mixture.

Corresponding apparatus for low $NO_x$ combustion, comprise first and second combustion zones, each filled with a said porous matrix, and said second zone being downstream of said first zone. Means are provided for mixing fuel and oxygen and providing same to said first combustion zone to establish fuel-rich conditions therein; and means for providing the combustion products from said first zone to said second zone and augmenting same with further fuel and sufficient additional oxygen to create lean burning conditions therein to complete the oxidation of the products from the first zone. In some instances the lean burning conditions of the second stage can be achieved by addition of air or oxidant without supplemental fuel.

Heat transfer by convection and radiation within the porous matrix element of the first zone preheats the incoming fuel/air mixture to yield a flame temperature which is higher than the theoretical adiabatic flame temperature for said mixture, thus allowing a broader range of fuel/air mixtures to be combusted under fuel rich conditions, and in which heat transfer by radiation from the non-porous walls of the second stage result in an overall lower-flame temperature for the second zone operating in a lean fuel/air ratio condition, and thus minimizing the formation of thermal $NO_x$.

Preferably the said apparatus further includes an additional zone filled with one or more porous matrix elements, which precedes, i.e., is upstream of the first combustion zone; and means to introduce fuel and air to said additional zone to create lean combustion conditions therein. Heat transfer within the first zone porous matrix preheats the incoming fuel lean fuel/air mixture and allows stable combination within minimum residence time at a temperature below 2800° F., to minimize the formation of "prompt" $NO_x$.

The porous matrix can comprise a porous ceramic foam, e.g. a reticulated silica-alumina or zirconia foam, in which case the voids are defined by the pores of the foam. Similarly the said matrix can comprise a packed bed—e.g. of ceramic balls, rods, fibers or other media which can withstand the high temperature of the combustion processes. In these instances the voids are defined by the interspaces among the media. It is important to point out here, that in the present invention, unlike certain prior art methodology, substantially all of the process combustion occurs in the void spaces of the matrix—not at surfaces of a ceramic or porous tube or the like. Also to be noted is that differing matrices can be used at the successive zones—and indeed the matrix at a given zone can comprise combinations of one or more contiguous sections, one of which may e.g. comprise a porous ceramic foam and another a packed bed, or so forth.

BRIEF DESCRIPTION OF THE DRAWINGS

The invention will be more readily apparent from the following detailed description, which should be read in conjunction with the appended drawings, in which.

DETAILED DESCRIPTION OF PREFERRED EMBODIMENTS

Figure 1:
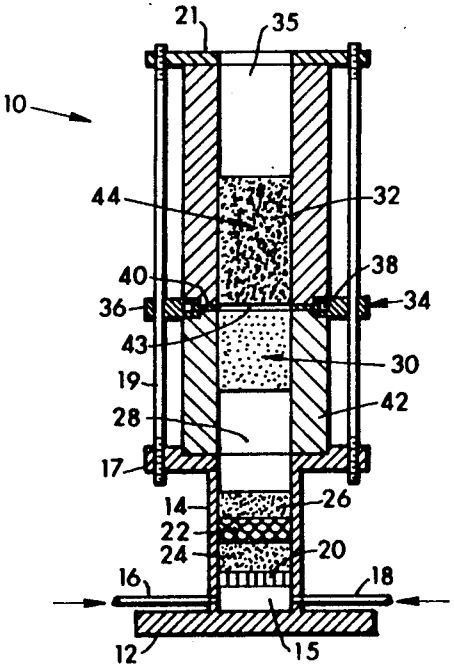
FIG. 1 is a longitudinal sectional view, highly schematic in nature, of a first embodiment of combustion apparatus in accordance with the present invention, which embodiment is based upon use of single combustion stage.

Referring to the drawings and particularly to FIG. 1, combustor or burner apparatus embodying features of the invention is designated generally by the reference numeral 10. The combustor or burner 10 is oriented with its axis vertical such that the flow of gases is upward along the vertical axis. Burner 10 conveniently has a base 12 which may be of metal such as steel. Seated upon base 12 is a hollow vertical column 14, the interior of which defines a conduit 15. Column 14 extends upwardly to a flange 17. Threaded rods 19 extend between flange 17 and an annular closing ring 21 between which is secured an alumina thermally insulating sleeve 42. On base 12, a fuel inlet 16 and an opposed inlet 18 for an oxidizer, for example air, are provided, which open into conduit 15. Alternatively, premixed reactants may enter the burner 10 through a two-stage mixing system (not shown) consisting of a primary mixing section into which fuel and air are introduced before being provided through the same inlets 16 and 18, which in these instances can be regarded as inlets into a secondary mixing chamber effectively defined within conduit 15. In any event, the objective is to provide a well mixed fuel with air or other oxidant combustible mixture.

The conduit or chamber 15 is essentially a stainless steel tube which is separated into two sections by a disk 20 of ceramic honeycomb which acts as a flow straightener. Above honeycomb 20, a thicker layer 22 of typically 5 mm diameter glass beads is sandwiched between two reticulated ceramic cylinders 24 and 26. Secondary mixing occurs in elements 22, 24 and 26. A void space 28 is located above this mixing section and below the preheat section 30 of the burner core. The burner core in FIG. 1 comprises the preheat or preflame section 30 and a combustion or postflame section 32, each being a porous ceramic cylinder constituted of partially stabilized zirconia (PSZ) having the general appearance of a sponge. Other ceramic foams such as reticulated silica alumina foam are suitable as are packed beds such as beds of saddles, balls, rods and the like; or other formulations with low pressure drop and capable of withstanding the temperatures typically present in combustion apparatus may be used. Foams utilizable in the invention include the silica alumina partially stabilized zirconia as mentioned, silicon nitride and silicon carbide foams of High Tech Ceramics, characterized as having from about 5 to 65 pores per inch (ppi). Typically the ceramic foam of section 30 has about 65 ppi; that of section 32 about 10 ppi. The average porosity of the ceramic media varies from 84 to 87% while the thermal conductivity, for example for the 10 ppi ceramic, is approximately 1 W/m-K.

In accordance with the present invention, a cooling means comprising a nonintrusive flame holder 34, is utilized to stabilize the reaction or combustion zone 44 defined within the porous ceramic section 32. The cooling means 34 is seen to be a generally toroidally shaped body 36 comprised, for example, of brass, which is water cooled by a channel 38 extending internally around the entire toroidal body. Cooling water is pumped through the channel 38 by an inlet and an outlet (not shown) which project from channel 38 to outside body 36. Other cooling media can also be furnished to the interior channel 38 and cooling can also be accomplished by a gas, including air. Water, however, is readily available and is a preferred medium for the cooling purposes. It is noted that the generally toroidal body 36 includes an inwardly extending lip portion 40, which reaches the inner diameter of the alumina heat insulation sleeve 42. Hence, it is seen that the innermost lip 40 of body 36 is in virtual contact with the outer periphery of the ceramic core, i.e. with sections 30 and 32. Typically in construction of the ceramic core, several adjacent ceramic sections such as at 30 and 32 are utilized, which may have differing porosity; i.e. as mentioned, in FIG. 1, the core section 30 being actually in the preflame area, may have a porosity of 65 ppi, whereas the main core section 32 whereat the actual flame combustion exists, may have a porosity of 10 ppi. Where separate sections are used as indicated, the cooling means or flame holder 34 is thus inserted between the two sections of the porous ceramic. However, noteworthy is that the said cooling means is thus positioned proximate to the combustible flow input end of core section 32, and is in thermal contact with the flow input end 43 of the combustion zone 44.

Ignition of the fuel-air mixture flowing through burner 10 can be enabled by any conventional means, including by igniting the flow at the final output 35 or at a convenient intermediate flow point.

Use of flame holder 34 is found to allow a broad range of equivalence ratio and flow rate combinations to be utilized in the apparatus 10, while maintaining a stable reaction zone. (By "equivalence ratio" is meant the ratio of fuel to oxygen on a stoichiometric basis.)

Experiments were thus performed to establish the range of equivalence ratios and flow rates over which the flame in the combustion zone 44 could be stabilized. In the test apparatus, section 32 was about 4.6 cm diameter by about 5 cm in length. There was a spacing of about 3.2 mm between sections 30 and 32. To ascertain the stability/instability of a given operating condition, stability criteria were defined as follows: Stable operation was defined as no change in the axial temperature profile after 5 minutes of operation. Stable operation also required that the flame be perpendicular to the burner axis (i.e. at each axial position).

Figure 2:
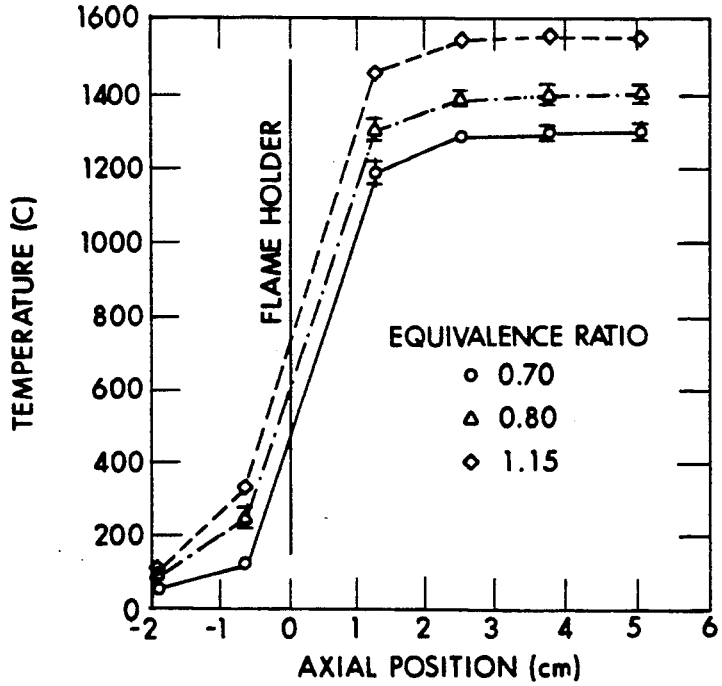
FIG. 2 is a graph, showing axial temperature distribution in combustion apparatus of the type shown in FIG. 1, for a fixed flow rate at three equivalence ratios.

In FIG. 2, the axial temperature distributions measured in a burner in accordance with FIG. 1 are shown for a flow rate of 60 slpm (standard liters per minute) at 3 equivalence ratios. Each data point in these distributions represents the average temperature of four circumferential measurements. The minimum and maximum temperatures measured among four thermocouples positioned at each axial position are represented by error bars. The small temperature difference between minimum and maximum readings at each axial position indicates that the flame orientation is perpendicular to the burner axis. The expected effect of stoichiometry on the peak burner temperature is also illustrated in this Figure. In considering FIG. 2, it is of particular interest to note that the flame holder axis defines what is substantially a line of discontinuity in temperature—although the graphs show the points to the left and right of the flame holder as being connected, the discontinuity will be evident. Basically what occurs is that the sharp drop in temperature achieved by use of the flame holder 34 assures that to the left of same (on the figure corresponding to upstream points in FIG. 1 with respect to flame holder 34), temperatures are below those at which ignition of the fuel-air mixture can occur.

Figure 3:
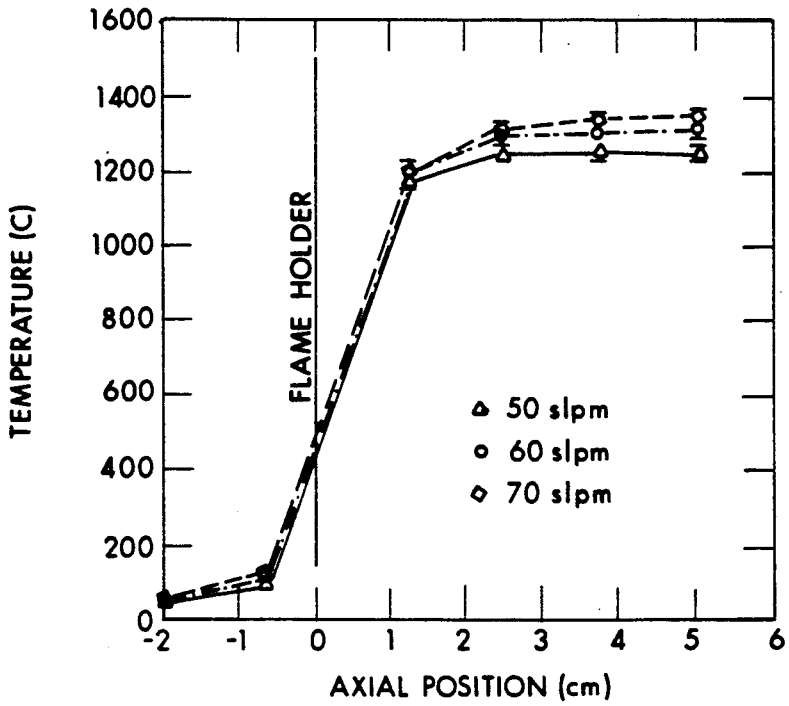
FIG. 3 is a graph, showing the effect of flow rate on the axial temperature distribution at constant equivalence ratio, for combustion apparatus of the type shown in FIG. 1.

The effect of flow rate on the axial temperature distribution is shown in FIG. 3, in which the temperature distribution is presented for three flow rates at an equivalence ratio of 0.7. Comparison of FIGS. 2 and 3 illustrates that equivalence ratio has a greater effect on the temperature distribution than does the flow rate. This is especially apparent in the preflame zone of the burner, upstream from the flame holder 34.

It is found that in apparatus as shown in FIG. 1, the flame stability limits for different equivalence ratios is very substantially increased in comparison to what may be achieved where apparatus similar to FIG. 1 but without the flame holder 34 is operated. Without the flame holder the only effective flame stabilization mechanism is heat loss from the entrance and exit regions of the burner. With the flame holder 34 present, lower flow rates can be used while maintaining the reaction zone at a relatively constant position. Such use also allows for rapid transition between such stable operating conditions. These are important characteristics in practical applications due to the common need to have a turndown ratio between 2:1 and 3:1.

The use of the flame holder 34 allowed the flame to be stabilized within the porous ceramic matrix of zone 44 over a wide range of equivalence ratios (0.6 to 1.5), and over flow rates (in the case of the described burner), from less than 50 to over 150 slpm. It was also found possible to achieve stable flames at burning speeds well in excess of the laminar flame speed. The temperature distribution measured around the burner annulus in the postflame zone was relatively insensitive to flow rate.

Figure 4:
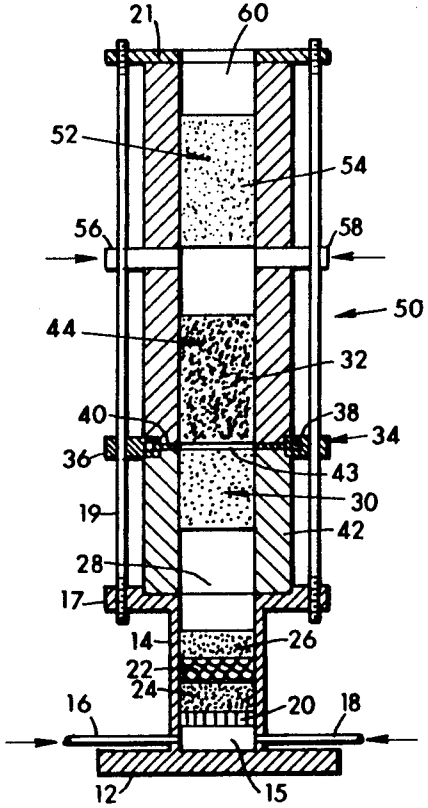
FIG. 4 is a schematic sectional view similar to FIG. 1, of another embodiment of the combustion apparatus of the invention, which is based on use of two combustion stages.

In FIG. 4, a further combustion apparatus, i.e. combustor or burner embodying features of the invention, is designated generally by the reference numeral 50. This device differs from the embodiment of FIG. 1, in including two combustion stages. The first stage, up to and including combustion zone 44 is identical in construction to the device of FIG. 1, and corresponding parts are identified by corresponding reference numerals.

The flow of the combustion products from first combustion zone 44, is seen to be provided to a second combustion zone 52. Zone 52 is also constituted by a porous ceramic matrix 54, which can be the same or different from the matrix 32 in zone 44. Between first combustion zone 44 and second combustion zone 52, inlets 56 and 58 are provided, for feeding additional fuel and oxygen-containing gas, e.g., air.

In operation of the two-stage embodiment of FIG. 4, the fuel and oxygen-containing gas to be fed are mixed by conventional mixing means to provide a mixture to chamber 15 containing oxygen which is present in 60 to 95%, typically 85% of the stoichiometric amount for the fuel, so that the mixture is a fuel "rich" mixture. The mixture typically has a temperature of 40° to 80° F. if no air preheat is employed as it passes through the mixing media 22. In first combustion zone 44 the mixture of fuel and oxygen-containing gas is ignited, and combustion takes place at a temperature of 1800° to 2800° F.

After the fuel-rich mixture has been combusted in zone 44, additional fuel and oxygen-containing gas are added to the product gases from zone 44 via inlets 56 and 58, to produce a fuel "lean" mixture wherein the oxygen present is 105 to 125%, typically 110% of the stoichiometric quantity, and the augmented lean mixture is combusted in the second combustion zone 52 at a temperature of 2000° to 2500° F., typically about 2250° F. This temperature range is low enough to prevent the formation of oxides of nitrogen either by "thermal" or "prompt" reaction mechanisms. Control of this temperature range is accomplished by the combined effects of fuel-air staging and of radiant heat transfer from the surface of the porous media.

In this operation, a portion of the combustion air and/or fuel bypasses the initial premix of fuel and air in the interior of the PM first combustion zone 44. Ignition and combustion of the initial mixture occurs under fuel rich conditions as a result of preheat generated by radiant feedback. Peak flame temperature occurs in this reducing zone as a result of radiant and convective preheat with minimum $NO_x$ formation. The air and/or fuel which is bypassed is then mixed with the products formed in the first combustion zone 44 to oxidize the excess combustibles, prior to exiting the PM burner at 60. The cooling effect of the radiant heat transfer from the PM burner results in a lower temperature than the theoretical flame temperature for the total combined fuel/air mixture in the second zone which is overall oxidizing. This combined effect results in lower $NO_x$ levels being achieved than would be possible for either a single staged or multiple staged burner employing diffusion burning.

In consequence, significant improvement in terms of $NO_x$ reduction is achieved vis-a-vis passage of all of the fuel and all of the oxygen through a single combustion zone, such as zone 44. Typically, e.g., a reduction of from 50 to 80% is achieved compared to a standard diffusion flame burner or a single stage pre-mix burner wherein combustion occurs either in the matrix or on the surface.

In a further preferred embodiment of the present invention, combustion also occurs in an additional lean burn combustion zone—which is upstream (i.e. in advance) of the fuel-rich zone. Thus, referring to FIG. 5, the combustor 100 includes in series fuel-rich and lean burn combustion zones 102 and 104. However, there is now provided upstream of and preceding combustion zone 102, an additional in series lean burn stage 108. This is again constituted by a porous ceramic matrix 110 which can be the same or different from the matrices in zones 102 and/or 104. Fuel and air enter inlet conduit 112 via inlets 114 and 116 and ceramic honeycomb flow straightener 118, and are further mixed with the aid of glass beads 120 or other mixing means which, as in FIG. 1, is sandwiched between reticulated ceramic cylinders 122 and 124. After passing through plenum 126, the mixture, which is appropriate for lean burning conditions, proceeds to and through preflame porous ceramic matrix 128 where further mixing occurs. The flow then passes the mean plane of the cooling means 130 (as previously described) and proceeds into the input end 109 of combustion zone 108, i.e. defined by porous ceramic matrix 110. Porous matrix 110 is comprised as previously described for the combustion zone 44 in FIG. 1.

Figure 5:
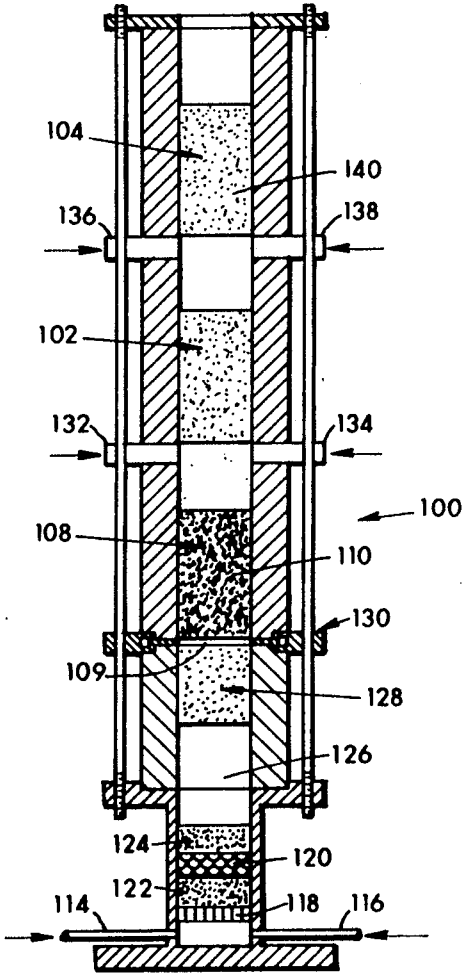
FIG. 5 is a schematic sectional view similar to FIGS. 1 and 3, of a further embodiment of the combustion apparatus of the invention, which is based on use of three combustion stages.

In operation of the apparatus in the embodiment of FIG. 5, the first combustion stage at zone 108, will be operated as a lean stage, i.e., the mixture fed to it will be a lean mixture in which the oxygen will be present in the mixture in 150 to 250% of the stoichiometric quantity. This zone is operated at a temperature of 1500° to 2500° F., typically 2000° F. Additional fuel and air are added via inlets 132 and 134, and the second combustion stage at zone 102 will be operated as a fuel-rich zone, i.e., the oxygen will be present in the mixture in 60 to 95% of the stoichiometric amount. The second combustion stage is at a temperature of 1000° to 2000° F., typically about 1800° F. The effluent mixture from the second combustion stage has added to it additional fuel and oxygen-containing gas, e.g., air, via inlets 136 and 138 to provide a lean mixture wherein the oxygen is present in 105 to 125% of the stoichiometric amount. This lean mixture is provided into the third combustion stage i.e. at zone 104 wherein combustion takes place at a temperature of 1000° to 2000° F., typically around 1800° F. Zone 104 is provided with a porous matrix 140 similar to matrix 32 in FIG. 1, e.g., comprising a ceramic foam or the like.

Thus in the process and apparatus depicted in FIG. 5, sufficient fuel mixes with the air in the first (lean) stage of apparatus 100 to provide for a combustion temperature in zone 108 below 1800° K. (2800° F.), to minimize thermal $NO_x$. In this stage, the residence time is minimized to convert fuel to CO but not totally to $CO_2$. In the second stage, i.e., at zone 102, the remainder of the fuel is added to obtain additional heat release, but again at a temperature below 1800° K. (2800° F.). Prompt $NO_x$ formation will be retarded because radicals from the first stage will attack the fresh fuel and energy will be rapidly released from the oxidation of CO. In the third stage, i.e., at combustion zone 104, sufficient air and/or fuel is added to complete overall heat release. At the same time, the presence of cooling means 130 precludes flame back to the preflame section 128, assuring that the downstream combustion in zone 108 is completely stable and controlled to minimize $NO_x$ as aforementioned.

It will be understood that various changes and modifications may be made in the embodiments described and illustrated without departing from the invention as defined in the appended claims. It is intended, therefore, that all matter contained in the foregoing description and in the drawings shall be interpreted as illustrative only, and not in a limiting sense.

What is claimed is:

1. Burner apparatus for use in controlled low $NO_x$ combustion, comprising:

mixing and flow-directing means for receiving and mixing fuel and a gaseous oxygen source provided thereto and forming a flow of the combustible mixture;

a combustion zone defined by a porous high temperature-resistant matrix, the void spaces of which provide sites at which substantially all of the said combustion occurs, said zone having an input end for receiving said combustible flow from said mixing and flow directing means; and cooling means mounted in proximity to said input end of said combustion zone, for maintaining the temperature of said combustible mixture at said input end below ignition temperature, thereby limiting the flame produced by combustion in said porous matrix to the downstream side of said cooling means, said means being mounted to be non-intrusive with respect to the interior of said porous matrix, thereby presenting no interference with the flow of said combustible mixture through said matrix, and comprising a generally toroidal hollow metal body surrounding and in thermal contact with the input end of said combustion zone, and means to circulate a coolant through said body.

2. Apparatus in accordance with claim 1, wherein said coolant is water.

3. Apparatus in accordance with claim 1, wherein said coolant is air.

4. Apparatus in accordance with claim 1, wherein said combustion zone is the first zone of first and second combustion zones, each filled with a porous high temperature resistant matrix, said second zone being downstream of said first zone; said means for mixing fuel and gaseous oxygen source providing the resultant combustible mixture to the input end of said first combustion zone to establish fuel-rich conditions therein; and including means for feeding the combustion products from said first zone to said second zone and augmenting same with further fuel and sufficient additional oxygen to create a fuel lean burning conditions therein to complete the oxidation of the products from said first zone.

5. Burner apparatus for use in controlled low $NO_x$ combustion, comprising:

mixing and flow-directing means for receiving and mixing fuel and a gaseous oxygen source provided thereto and forming a flow of the combustible mixture;

a combustion zone defined by a porous high temperature-resistant matrix, the void spaces of which provide sites at which substantially all of the said combustion occurs, said zone having an input end for receiving said combustible flow from said mixing and flow directing means; and cooling means mounted in proximity to said input end of said combustion zone, for maintaining the temperature of said combustible mixture at said input end below ignition temperature, thereby limiting the flame produced by combustion in said porous matrix to the downstream side of said cooling means;

first, second, and an additional combustion zone being provided, each zone being filled with a porous high temperature resistant matrix; said additional zone being upstream of the first combustion zone and including means to provide said initial mixture of fuel and air to said additional zone and to adjust the air-fuel ratio to create fuel lean combustion conditions therein; the flow of combustion products from said additional zone being provided to the input end of said first combustion zone, and means being present thereat to establish fuel-rich conditions in said first zone, said apparatus including means for feeding the combustion products from said first zone to said second zone and augmenting same with further fuel and sufficient additional oxygen to create fuel lean burning conditions in said second zone to complete the oxidation of the products from said first zone; said cooling means being mounted in proximity to the input end of said additional combustion zone and being non-intrusive with respect to the interior of said porous matrix, thereby presenting no interference with the flow of said combustible mixture through said matrix, and comprising a generally toroidal hollow metal body surrounding and in thermal contact with the input end of said combustion zone, and means to circulate a coolant through said hollow body.

6. Apparatus for low $NO_x$ combustion, comprising first and second combustion zones, each filled with a porous high temperature resistant matrix, the void spaces of which provide sites at which substantially all of the said combustion occurs, said second zone being downstream of said first zone; means for mixing fuel and a gaseous source of oxygen and providing the resultant combustible mixture to the input end of said first combustion zone to establish fuel-rich conditions therein; and means for feeding the combustion products from said first zone to said second zone and augmenting same with further fuel and sufficient additional oxygen to create lean burning conditions therein to complete the oxidation of the products from said first zone; and cooling means mounted in proximity to said input end of said first combustion zone, for maintaining the temperature of the said combustible mixture at said input end below ignition temperature thereby limiting the flame produced by combustion in said porous matrix to the downstream side of said cooling means, said cooling means being mounted to be non-intrusive with respect to the interior of said porous matrix, thereby presenting no interference with the flow of said fuel-air mixture through said matrix and comprising a generally toroidal hollow metal body surrounding and in thermal contact with the input end of said combustion zone, and means to circulate a coolant through said hollow body.

7. Apparatus for low $NO_x$ combustion, comprising first and second in series combustion zones, each filled with a porous high temperature resistant matrix, the void spaces of which provide sites at which substantially all of the combustion in said zones occurs, said second zone being downstream of said first zone; an additional zone filled with said porous matrix being upstream of the first combustion zone and in series therewith; means to flow an initial mixture of fuel and air to the input end of said additional zone and to adjust the air-fuel ratio to create lean combustion conditions therein; means for feeding the combustion products from said additional zone to said first zone and augmenting same with further fuel and additional air to establish fuel-rich conditions therein; means for feeding the combustion products from said first zone to said second zone and augmenting same with further fuel and sufficient additional oxygen to create lean burning conditions therein to complete the oxidation of the products from said first zone; and cooling means mounted in proximity to the input end of said additional combustion zone, for maintaining the temperature of the fuel-air mixture at said input end below ignition temperature thereby limiting the flame produced by combustion in said porous matrices to the downstream side of said cooling means; said cooling means being mounted to be non-intrusive with respect to the interior of said porous matrix, thereby presenting no interference with the flow of said combustible mixture through said matrix, and comprising a generally toroidal hollow metal body surrounding and in thermal contact with the input end of said combustion zone, and means to circulate a coolant through said hollow body.

8. A combustion process enabling controlled low $NO_x$ combustion, comprising:

mixing fuel and air and forming a flow stream of the fuel-air mixture;

passing said flow stream to an input end of a combustion zone defined by a porous high temperature-resistant matrix;

combusting said mixture at said matrix, the void spaces of which provide sites at which substantially all of the said combustion occurs;

flowing the combustion products from an input end of said matrix; and cooling said input end of said combustion zone, to maintain the temperature of said fuel-air mixture at said input end below ignition temperature, thereby limiting the flame produced by combustion in said porous matrix to the downstream side of said cooling means;

said cooling being effected by thermally contacting the input end of said combustion zone with a fluid-cooled metal body, said means being mounted to be non-intrusive with respect to the interior of said porous matrix, thereby presenting no interference with the flow of said fuel-air mixture through said matrix.

9. A method in accordance with claim 8, wherein said metal body is cooled by water provided to internal channels thereof.

10. A combustion process for controlled low $NO_x$ combustion, comprising:

flowing a combustible mixture of fuel and oxidant through a plurality of porous ceramic matrices arranged in series, at least one of said matrices being an initial combustion zone for said gaseous mixture, and providing cooling to said mixture as it flows into the surface of said one matrix to maintain the mixture temperature at the said surface below the ignition temperature thereof, to preclude upstream flame-back from said one matrix;

said cooling being effected by thermally contacting the input end of said combustion zone with a fluid-cooled metal body, said means being mounted to be non-intrusive with respect to the interior of said porous matrix, thereby presenting no interference with the flow of said fuel-air mixture through said matrix.

11. A process in accordance with claim 10, wherein an additional ceramic matrix precedes said one matrix, and provides added mixing of said mixture proceeding to said one matrix.

12. A combustion process for controlled low $NO_x$ combustion, comprising:

flowing a combustible mixture of fuel and oxidant through a plurality of porous ceramic matrices arranged in series, at least one of said matrices being an initial combustion zone for said gaseous mixture, and providing cooling to said mixture as it flows into the surface of said one matrix to maintain the mixture temperature at the said surface below the ignition temperature thereof, to preclude upstream flame-back from said one matrix;

said cooling being effected by thermally contacting the input end of said combustion zone with a fluid-cooled metal body, said means being mounted to be non-intrusive with respect to the interior of said porous matrix, thereby presenting no interference with the flow of said fuel-air mixture through said matrix.

the combustion in said one matrix being under fuel-rich reducing conditions; and a further ceramic matrix being provided downstream of said one matrix; additional fuel and oxidant being added to the flow of combustion products from said one matrix to enable combustion in said further matrix under fuel-lean conditions.

13. A combustion process for controlled low $NO_x$ combustion, comprising:

flowing a combustible mixture of fuel and oxidant through a plurality of porous ceramic matrices arranged in series, at least one of said matrices being an initial combustion zone for said gaseous mixture, and providing cooling to said mixture as it flows into the surface of said one matrix to maintain the mixture temperature at the said surface below the ignition temperature thereof, to preclude upstream flame-back from said one matrix;

said cooling being effected by thermally contacting the input end of said combustion zone with a fluid-cooled metal body, said means being mounted to be non-intrusive with respect to the interior of said porous matrix, thereby presenting no interference with the flow of said fuel-air mixture through said matrix;

the combustion in said one matrix being under fuel-lean conditions; and wherein first and second further said matrices are provided downstream of said one matrix; additional fuel and oxidant being added to the flow of combustion products from said one matrix to enable combustion in said first matrix under fuel-rich conditions; and additional fuel and oxidant being added to the flow of combustion products from said first matrix to enable combustion in said second matrix under fuel-lean conditions.

* * * * *